US009375070B2

(12) United States Patent
Tsuhara et al.

(10) Patent No.: US 9,375,070 B2
(45) Date of Patent: Jun. 28, 2016

(54) STICK-TYPE COSMETIC HOLDER

(71) Applicant: KOSE Corporation, Chuo-ku (JP)

(72) Inventors: Kazuhiro Tsuhara, Saitama (JP); Hideyuki Onoe, Saitama (JP); Kei Arai, Saitama (JP); Hideto Shiba, Saitama (JP)

(73) Assignee: KOSE Corporation, Chuo-ku (JP)

( * ) Notice: Subject to any disclaimer, the term of this patent is extended or adjusted under 35 U.S.C. 154(b) by 0 days.

(21) Appl. No.: 14/366,090

(22) PCT Filed: Dec. 14, 2012

(86) PCT No.: PCT/JP2012/082513

§ 371 (c)(1),
(2) Date: Jun. 17, 2014

(87) PCT Pub. No.: WO2013/094536

PCT Pub. Date: Jun. 27, 2013

(65) Prior Publication Data

US 2014/0363214 A1 Dec. 11, 2014

(30) Foreign Application Priority Data

Dec. 21, 2011 (JP) ..... 2011-279504

(51) Int. Cl.
*A45D 40/04* (2006.01)
*A45D 40/24* (2006.01)
(Continued)

(52) U.S. Cl.
CPC ..... *A45D 40/20* (2013.01); *A45D 40/04* (2013.01); *A45D 40/06* (2013.01); *A45D 2040/0025* (2013.01)

(58) Field of Classification Search
CPC ..... A45D 40/20; A45D 40/06; A45D 40/04
USPC ..... 401/88, 63–79
See application file for complete search history.

(56) References Cited

U.S. PATENT DOCUMENTS 4,186,772 A * 2/1980 Handleman ..... A62C 31/12 137/891
7,422,387 B2 * 9/2008 Kurihara ..... A45D 40/06 401/78

FOREIGN PATENT DOCUMENTS

CH 280678 A 1/1952
CN 201509802 U 6/2010
(Continued)

OTHER PUBLICATIONS

International Search Report Issued Mar. 12, 2013 in PCT/JP12/082513 Filed Dec. 14, 2012.
(Continued)

*Primary Examiner* — Mark A Laurenzi
*Assistant Examiner* — Thomas M Abebe
(74) *Attorney, Agent, or Firm* — Oblon, McClelland, Maier & Neustadt, L.L.P.

(57) ABSTRACT

A stick-type cosmetic holder is formed in a cylindrical shape opened at upper and lower ends. On an inner peripheral surface, an inner diameter is gradually decreased from an upper opening downward to provide an upper tapered surface, and the inner diameter is gradually decreased from a lower opening upward to provide a lower tapered surface. A single annular step portion forming a step such that the lower tapered surface side is higher than the upper tapered surface side is provided at a boundary between the upper tapered surface and the lower tapered surface. The step portion is formed with an inclination in relation to the axial center as viewed from the lateral side. Moreover, taper angles of the upper and lower tapered surfaces are 1° to 10°, and the height of the step portion is 0.1 to 2.0 mm.

10 Claims, 8 Drawing Sheets

(51) Int. Cl.

| | |
|---|---|
| ***B65D 51/00*** | (2006.01) |
| ***B02C 1/08*** | (2006.01) |
| ***B43K 21/02*** | (2006.01) |
| ***B43K 3/00*** | (2006.01) |
| ***A45D 40/20*** | (2006.01) |
| ***A45D 40/06*** | (2006.01) |
| *A45D 40/00* | (2006.01) |

(56) References Cited

FOREIGN PATENT DOCUMENTS

| | | | | |
|---|---|---|---|---|
| GB | 705060 | A | | 3/1954 |
| JP | 8 150018 | | | 6/1996 |
| JP | 08150018 | A | * | 6/1996 |
| JP | 9 131218 | | | 5/1997 |
| JP | 2001 87033 | | | 4/2001 |
| JP | 2001 186920 | | | 7/2001 |
| JP | 2002 349 | | | 1/2002 |
| JP | 2007 260164 | | | 10/2007 |
| JP | 2009 226004 | | | 10/2009 |
| JP | 2012 29866 | | | 2/2012 |

OTHER PUBLICATIONS

Office Action mailed Mar. 1, 2016 in Chinese Patent Application No. 201280063950.8.

* cited by examiner

STICK-TYPE COSMETIC HOLDER

TECHNICAL FIELD

The present invention relates to a holder for holding a stick-type cosmetic, formed in a way that allows free up and down movement in a stick-type cosmetic container.

BACKGROUND ART

Recently, lipsticks that are soft to the touch and highly glossy are demanded in the market. In order to embody such demanded quality, back filling technique, that is, a manufacturing method including turning a container upside down, directly filling the inside of the container with a heat-melted cosmetic through a filling hole in the bottom, then cooling the cosmetic to solidify, thus molding a stick-type cosmetic, is advantageous and commonly carried out. In this method, generally, in a cylindrical portion (sleeve) that is a part of the container, a cylindrical cosmetic holder that can move up and down within the cylindrical portion is installed, and the inside of these cylindrical members is directly filled with a heat-melted cosmetic (bulk), which is then cooled in that state to solidify (Patent Literatures 1 and 2).

Since the sleeve and the holder are directly filled with the cosmetic molded by such a back filling technique, a part of the cosmetic after solidification may adhere to an inner wall surface of the sleeve of the container. When the cosmetic installed on the holder is moved up at the start of use, such adherence may cause high downward stress (in the direction toward the bottom) to act on the cosmetic. Also, in normal use for application, the distal end of the cosmetic is pressed by an object to be applied and therefore downward stress on the cosmetic is generated. Such downward stress acts as a force which withdraws the cosmetic downward from the cylindrical holder. Therefore, in order to prevent this, measures need to be taken to hold and fix the cosmetic on the holder. A common method for this is to provide one or a plurality of protrusions (ribs) such as pawl portions on the inner wall of the holder, load and solidify the melted cosmetic, and engage and hold the cosmetic with the ribs (Patent Literature 3).

However, the method of engaging and holding the cosmetic with the ribs has the following problem. That is, on the cosmetic molded by the back filling technique, stress is generated by the adherence of the cosmetic to the inner wall surface of the sleeve of the container during the moving-up action as described above. Such stress consequently concentrates on the engagement holding part between the cosmetic and the holder, that is, the rib portions.

In the engagement holding of the cosmetic via the ribs, the holding strength is secured by the hardness of the solidified cosmetic itself. Therefore, with a soft cosmetic, the holding strength in the holder via the ribs deteriorates, and sufficient holding cannot be realized if stress as described above is applied. Particularly, if, for example, a softer touch in the use of a stick-type cosmetic such as a lipstick is obtained by reducing the content of solid oil that forms the structure, the cosmetic itself becomes fragile. Therefore, in the conventional type of holder that holds the cosmetic with the ribs, the problem is that when stress concentrates on the engaged portion with the ribs as described above, the cosmetic in that part collapses and the cosmetic is not sufficiently held on the holder.

As a countermeasure against this, the engagement holding strength may be improved by increasing dimension including the size, length, and height of the ribs. However, there is an intrinsic characteristic of ribs such that, when filling the inside of the holder with the heat-melted cosmetic, the presence of protrusions such as ribs within the holder may cause disturbance in the flow of the melted cosmetic in the surrounding part, leaving air bubbles in the surrounding part after the filing is completed. Then, since the molten cosmetic begins to cool down immediately as it is loaded, and also due to the intrinsically low fluidity of the molten cosmetic, the cosmetic is consequently cooled and solidified with the air bubbles remaining near the ribs and forming cavities. The cavities around the ribs lower the engagement holding strength of the ribs on the cosmetic and may cause molding defects. Increasing the dimension of the ribs facilitates the generation of such air bubbles and increases the incidence of molding defects. Therefore, this is not sufficient as a method for improving the holding strength, particularly for a stick-type cosmetic with a soft touch and low mechanical strength.

As described above, damage and molding defects of the cosmetic on the rib portions become a further cause of a deterioration of the engagement holding strength of the holder with respect to a stick-type cosmetic, particularly, a stick-type cosmetic with a soft touch and low mechanical strength. Consequently, there is a disadvantageous that that the movement of the holder and the movement of the cosmetic do not interlock with each other or the cosmetic is pushed down in use, or the like. Furthermore, not only in normal use for application but also when the container is accidentally dropped and subject to a strong external impact, the cosmetic may fly out of the holder, damaging the surface of the cosmetic.

Patent Literature 4 discloses a configuration in which, though not for a cosmetic formed by the back filling technique, ribs as protrusions are formed in a spiral direction, thus enhancing the fitting strength with a middle tray (holder) so that the cosmetic is less likely to come off.

However, in this configuration, since the ribs are continuously formed in a spiral form, air bubbles are more likely to be generated near the ribs, posing the risk of molding defects if this is applied to a cosmetic formed by the back filling technique. Also, since stress is applied in a concentrated manner on the rib portions, there is a possibility that breaking starts at the rib portions, particularly in the case of a stick-type cosmetic with a soft touch. Moreover, since the stick-type cosmetic is required to be screwed in, the resistive force of the ribs that prevents the movement of the cosmetic in the rotating direction is not sufficient.

Thus, in order to solve the foregoing problems, the present applicant has invented a stick-type cosmetic holder which is formed in a cylindrical shape opened at the upper and lower ends and in which taper that gradually decreases the inner diameter from the upper opening side to a substantially central part is provided on the inner peripheral surface and a plurality of step portions are provided annularly on the inner peripheral surface where the taper is provided so that the substantially central part is higher than the upper opening side, with the step portions being formed with an inclination in relation to the axial center of the cylindrical shape as viewed from the lateral side (Patent Literature 5). That is, in this stick-type cosmetic holder, stress in vertical directions applied on the stick-type cosmetic held therein is received by the inner peripheral surface where the inner diameter of the holder is gradually decreased to form the taper (hereinafter referred to as a tapered surface) and stress in the directions of rotating the stick-type cosmetic within the holder is received by the step surfaces of the step portions, thus enabling secure holding of the stick-type cosmetic.

By the way, while such a stick-type cosmetic holder has no particular problems with a soft cosmetic as described above, the following problem may be considered when the cosmetic has normal hardness. That is, in order to realize a cosmetic with typical hardness, the content of wax needs to be increased. However, the rate of contraction of the cosmetic due to the cooling and solidifying when molding is known to rise with increase in the content of wax. Also, in the stick-type cosmetic holder of the invention of the applicant, since a plurality of step portions provides high holding strength, the cosmetic cannot properly contract within the cosmetic holder. Consequently, there is a possibility that damage such as cracks may occur partly in the cosmetic.

Patent Literature 1: JP-A-2001-87033
Patent Literature 2: JP-A-2002-349
Patent Literature 3: JP-A-2009-226004
Patent Literature 4: JP-A-2001-186920
Patent Literature 5: Japanese Patent Application 2010-171984

SUMMARY OF INVENTION

Technical Problem

Thus, it is an object of the present invention to provide a stick-type cosmetic holder which overcomes such drawbacks of the conventional stick-type cosmetic holder, enhances the engagement holding strength in vertical and rotating directions on the stick-type cosmetic, disperses the stress that is conventionally concentrated on the ribs so as to prevent damage to the cosmetic, prevents molding defects of the cosmetic due to air bubbles, and thus can securely engage and hold the stick-type cosmetic, and which can prevent molding defects due to the occurrence of cracks even when used for a cosmetic with normal hardness.

Solution to Problem

The present invention is to solve the foregoing problems and relates to a stick-type cosmetic holder which is formed in a cylindrical shape opened at the upper and lower ends. On the inner peripheral surface, the inner diameter is gradually decreased from the upper opening downward to form an upper tapered surface, and the inner diameter is gradually decreased from the lower opening upward to form a lower tapered surface. A single annular step portion forming a step such that the lower tapered surface side is higher than the upper tapered surface side is provided at the boundary between the upper tapered surface and the lower tapered surface. The step portion is formed with an inclination in relation to the axial center as viewed from the lateral side. The taper angles of the upper and lower tapered surfaces range from 1° to 10°, and the height of the step portion ranges from 0.1 to 2.0 mm.

Advantageous Effects of Invention

In the stick-type cosmetic holder of the present invention, stress in vertical directions applied on the stick-type cosmetic held therein is received by the inner peripheral surface where the inner diameter of the holder is gradually decreased to form the taper (hereinafter referred to as tapered surfaces), and stress in the directions of rotating the stick-type cosmetic within the holder is received by the step surface of the step portion provided with an inclination in relation to the axial center of the holder, thereby enabling secure holding of the stick-type cosmetic. Also, since the stress that is conventionally concentrated locally on the engagement holding portion formed by protrusions such as ribs is dispersed on the surface, the cosmetic is less likely to be damaged near the engagement holding portion. Moreover, since air bubbles or the like due to the protrusions are less likely to be generated when molding, molding defects can be effectively prevented. Therefore, the stick-type cosmetic holder of the present invention has an excellent engagement holding property not only for a stick-type cosmetic with normal hardness but also for a stick-type cosmetic with a soft touch and low mechanical strength that is difficult to hold via protrusions such as ribs.

Moreover, in the stick-type cosmetic holder of the present invention, the single step portion is provided on the inner peripheral surface of the holder, and the taper angles of the tapered surfaces or the height of the step portion are set within a predetermined range. Therefore, molding defects due to the occurrence of cracks can be effectively prevented in a stick-type cosmetic with normal hardness where cracks may be generated particularly easily, without preventing proper contraction of the cosmetic due to the cooling and solidifying when molding.

DESCRIPTION OF EMBODIMENTS

Hereinafter, an embodiment of a stick-type cosmetic holder of the present invention will be described specifically, based on the drawings. It should be noted that the invention is not limited by the embodiment at all.

Figure 1:
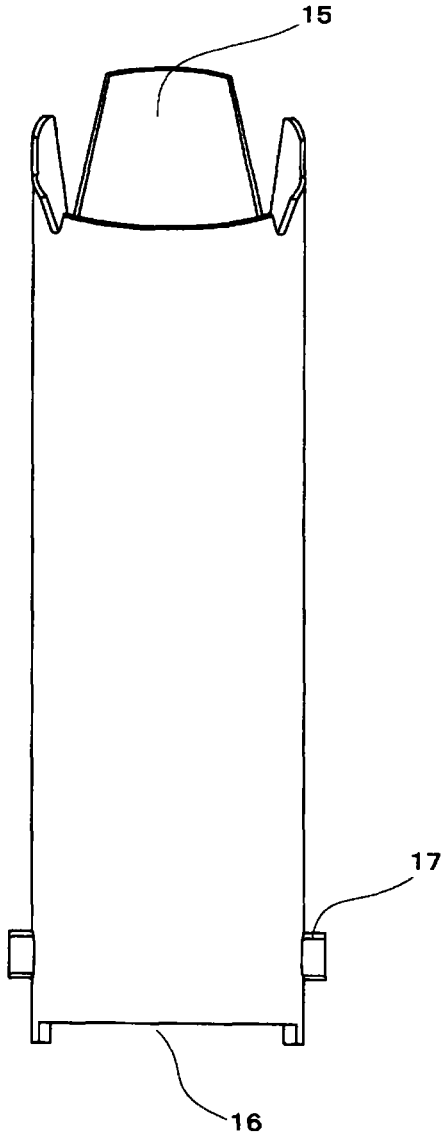
FIG. 1 A front view of a stick-type cosmetic holder of the invention.
Figure 2:
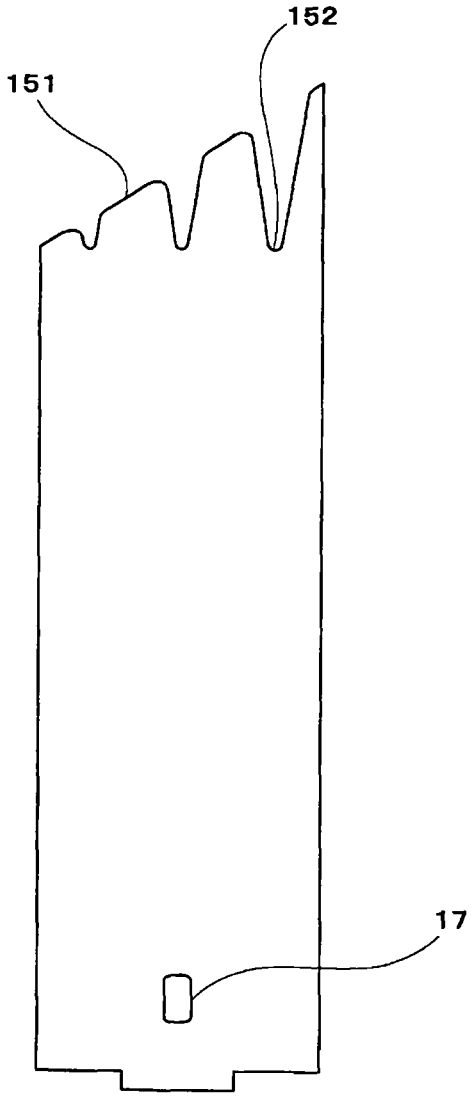
FIG. 2 A side view of the stick-type cosmetic holder of the invention.
Figure 3:
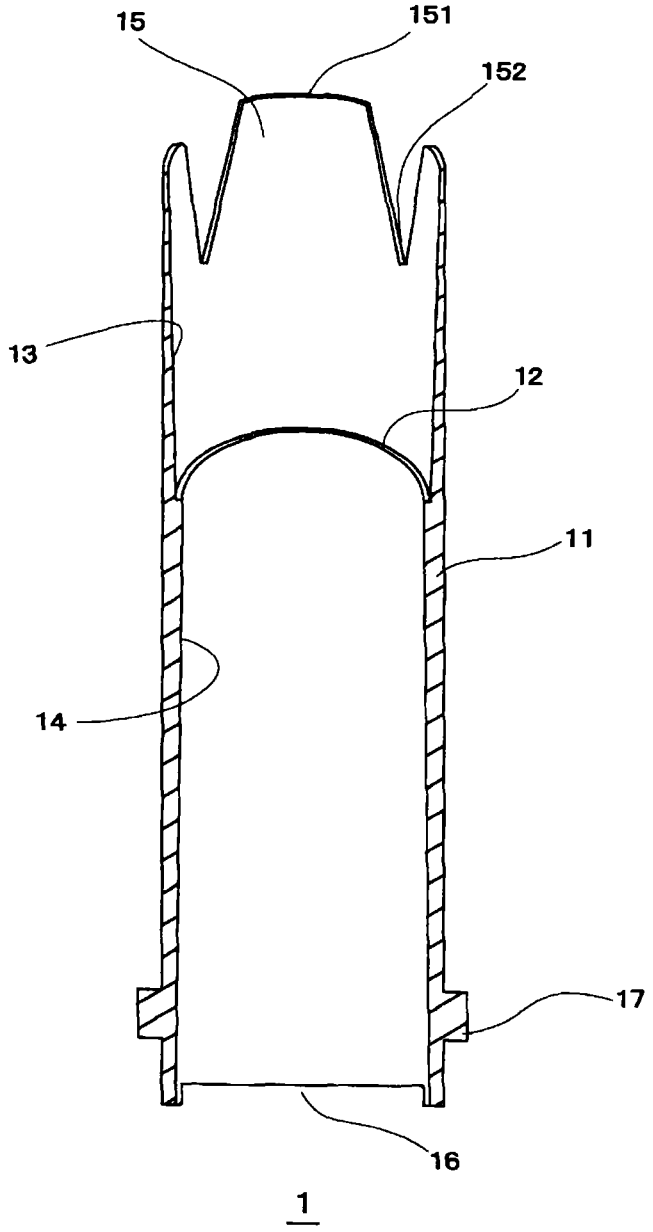
FIG. 3 A front cross-sectional view of the stick-type cosmetic holder of the invention.
Figure 4:
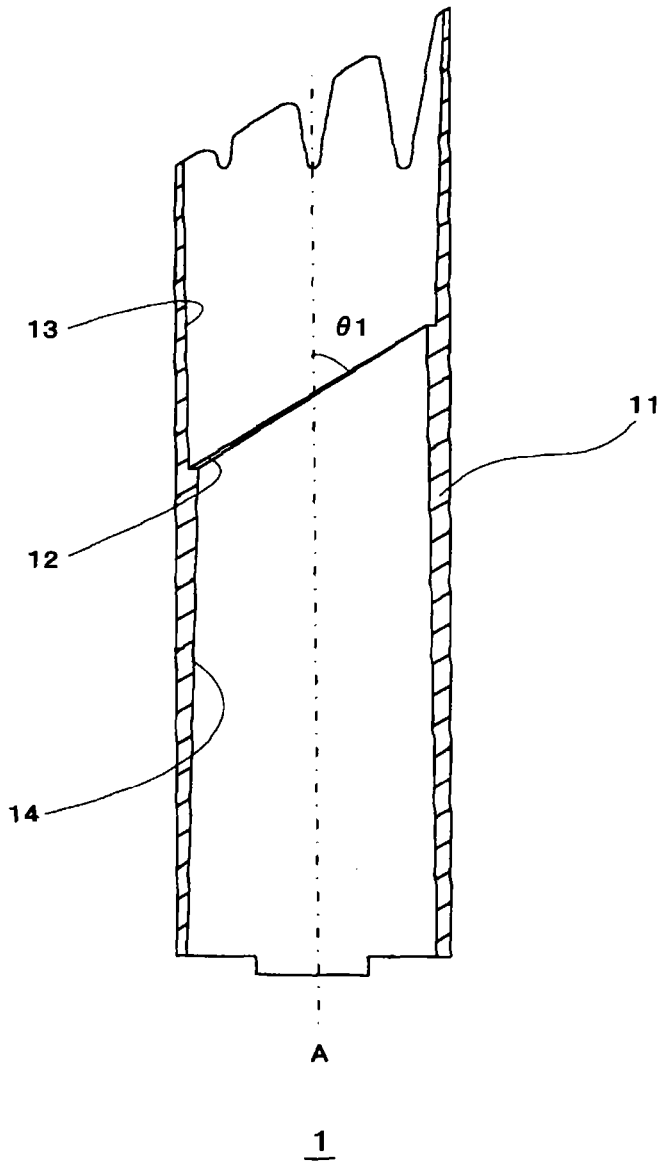
FIG. 4 A side cross-sectional view of the stick-type cosmetic holder of the invention.
Figure 5:
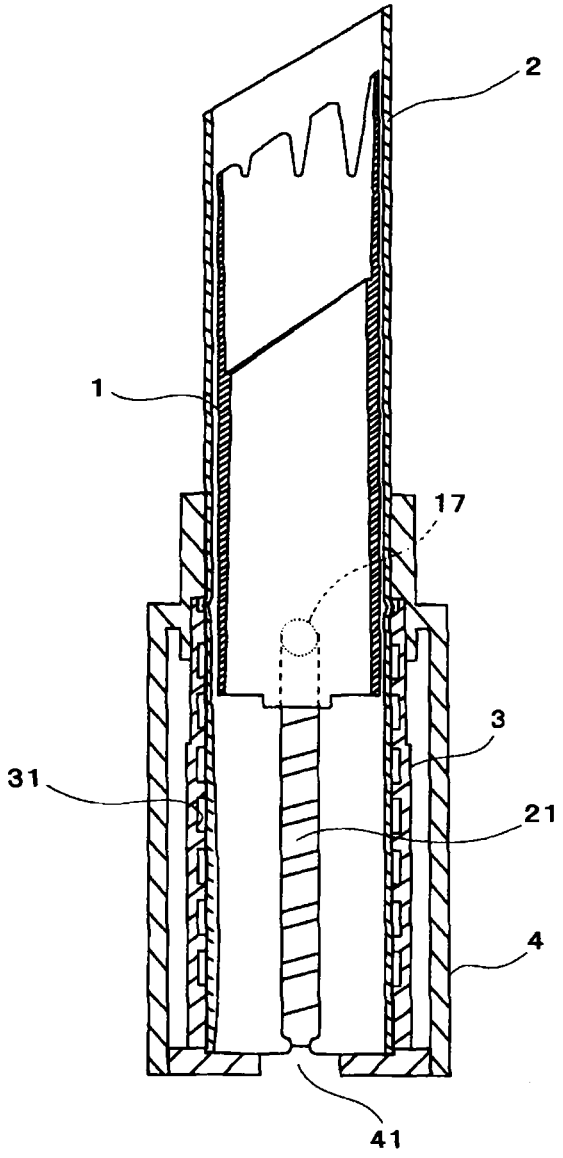
FIG. 5 A cross-sectional view of a stick-type cosmetic container on which the stick-type cosmetic holder of the invention is assembled.
Figure 6:
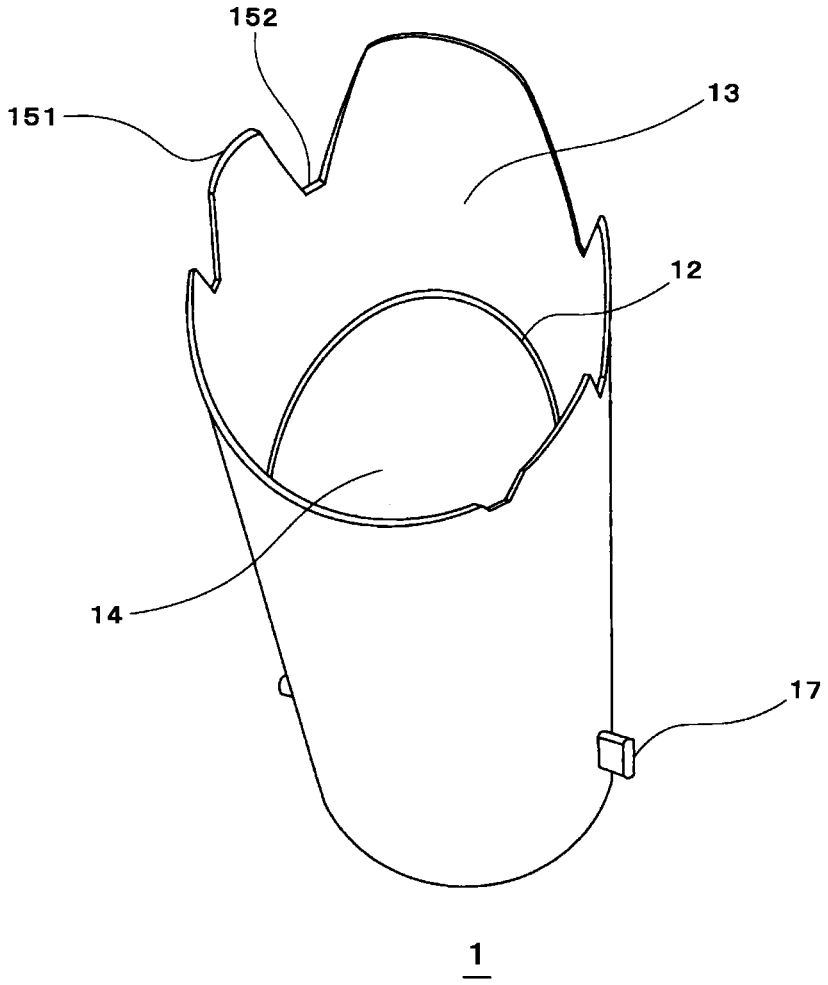
FIG. 6 A perspective view of the stick-type cosmetic holder of the invention.

FIG. 1 is a front view of the stick-type cosmetic holder of the invention. FIG. 2 is a side view of the same. FIG. 3 is a front cross-sectional view of the same. FIG. 4 is a side cross-sectional view of the same. FIG. 5 is a side cross-sectional view of a stick-type cosmetic container on which the stick-type cosmetic holder of the invention is assembled. FIG. 6 is a perspective view of the stick-type cosmetic holder. In the drawings, 1 denotes a stick-type cosmetic holder, 2 denotes a sleeve, 3 denotes a rotating cylinder, 4 denotes a container outer cylinder, 11 denotes a peripheral wall, 12 denotes a step portion, 13 denotes an upper tapered surface, 14 denotes a lower tapered surface, 15 denotes an upper opening, 16 denotes a lower opening, 17 denotes a protruding portion, 21 denotes a guide groove, 31 denotes a spiral groove, 41 denotes a container bottom filling hole, 151 denotes an opening edge, 152 denotes a cut-out portion, A denotes an axial center, and θ1 denotes an inclination angle of the step portion in relation to the axial center.

As shown in FIGS. 1 to 5, the stick-type cosmetic holder 1 of the present invention is formed in a cylindrical shape having the openings 15, 16 at the upper and lower ends. The opening edge 151 of the upper opening 15 is formed obliquely as viewed from the lateral side. The protruding portion 17 is formed in a lower part on the outer peripheral surface of the peripheral wall 11. As the rotating cylinder 3 rotates, this protruding portion 17 moves up and down along the spiral groove 31 in the rotating cylinder 3 and the guide groove 21 in the sleeve 2. Thus, the stick-type cosmetic holder 1 moves up and down in the sleeve 2. When filling the stick-type cosmetic holder 1 with a cosmetic, the distal end of the sleeve 2 is sealed with a cap-shaped member (not shown) and the container is turned upside down. Via the container bottom filling hole 41 and the lower opening 16 of the stick-type cosmetic holder 1, a heat-melted cosmetic is poured into the sleeve 2 and into the holder 1. Subsequently, the cosmetic becomes available for use through a cooling and solidifying process.

In the stick-type cosmetic holder 1 of this embodiment, the inner diameter is gradually decreased from the upper opening 15 downward to form the upper tapered surface 13, and the inner diameter is gradually decreased from the lower opening 16 upward to form the lower tapered surface 14, as shown in FIGS. 3 and 4. At the boundary between the upper tapered surface 13 and the lower tapered surface 14, the step portion 12 is provided so as to form a step where the side of the lower tapered surface 14 is higher than the side of the upper tapered surface 13. The step portion 12 is formed at a site that is substantially one-third in length from the upper opening 15. The height of the step is preferably 0.1 to 2 mm, and more preferably 0.3 to 0.5 mm although it is expected to vary depending on the relation with the taper angles of the tapered surfaces 13, 14. Also, while the taper angles of the tapered surfaces 13, 14 are expected to vary depending on the relation with the height of the step portion 12, the angles are preferably formed within a range of 1° to 10°.

The step portion 12 in this embodiment is formed in an annular shape on the inner peripheral surface of the peripheral wall 11 of the stick-type cosmetic holder 1. As shown in FIG. 4, the annular shape is provided, not perpendicularly to the axial center A of the stick-type cosmetic holder 1 but with an inclination. While the inclination angle θ1 in this embodiment is substantially equal to the inclination angle of the opening edge 151 as viewed from the lateral side, the angle need not necessarily be set in this manner and can be properly set within the preferred range of 5° to 85°. Considering the frictional force with the cosmetic and the range available for formation within the tapered surface, 45° to 60° is particularly preferable.

In this manner, in the stick-type cosmetic holder 1 in this embodiment, the inner diameter is gradually decreased to the step portion 12 from the upper opening 15 and the lower opening 16, thus forming the tapered surfaces 13, 14. Therefore, in the entirety of the stick-type cosmetic holder 1, the inner diameter is maximized at the upper and lower ends, becoming gradually narrowed toward the step portion 12 and reaching its minimum at the step portion 12. While the thickness of the peripheral wall 11 of the stick-type cosmetic holder 1 is made gradually thicker from the upper opening 15 and the lower opening 16 to the step portion 12 to form the tapered surfaces 13, 14 in this embodiment, the tapered surfaces may not necessarily be formed in this manner, and for example, the outer diameter of the stick-type cosmetic holder 1 as well as the inner diameter may be decreased while keeping the thickness of the peripheral wall 11 constant, thus forming an outer peripheral wall portion that is constricted corresponding to the position where the step portion 12 is formed.

As described above, in the stick-type cosmetic holder 1 of the present invention, since the upper tapered surface 13 and the lower tapered surface 14 are provided on the inner peripheral surface above and below the step portion 12 as the boundary, stress applied on the cosmetic in use can be dispersed. Specifically, downward stress acting on the cosmetic at the start of use or in normal use for application is received by the entirety of the upper tapered surface 13 and is thus dispersed. Therefore, downward movement of the stick-type cosmetic can be prevented. Also, upward stress that can be generated by dropping the container or the like is received by the entirety of the lower tapered surface 14 and is thus dispersed. Therefore, upward movement of the cosmetic can be prevented.

Meanwhile, stress in the directions of rotating the stick-type cosmetic held within the stick-type cosmetic holder 1 can be received by the step portion 12. Therefore, shifts of the cosmetic in the rotating directions can be prevented. That is, since the step portion 12 is formed in an annular shape on the inner peripheral surface of the stick-type cosmetic holder 1, and the annular surface is inclined in relation to the axial center A of the stick-type cosmetic holder 1, the step portion 12 forms one cycle of waveform in the development view of as the stick-type cosmetic holder 1 in the cylindrical shape is expanded into a plane. Therefore, the regulation of movement in the rotating directions by the step portion 12 is a movement regulating effect of engaging the peak and trough of the wave with each other formed by each of the step surface of the step portion 12 of the stick-type cosmetic holder 1 and the stick-type cosmetic. Moreover, vertical movements are regulated by the upper tapered surface 13 and the lower tapered surface 14 as described above. Thus, the two work in cooperation with each other, consequently enabling effective prevention of shifts in the rotating directions.

Also, since the stick-type cosmetic holder 1 of the present invention does not have protrusions such as ribs for holding the cosmetic, within the holder, air bubbles in the engagement holding portion are less likely to be generated when molding the cosmetic. Moreover, since there is no local stress concentrated on the engagement holding portion, damage to a part of the cosmetic near the engagement holding portion does not occur. Therefore, the stick-type cosmetic holder 1 of the present invention can securely hold not only a stick-type cosmetic with normal hardness but also a stick-type cosmetic with a soft touch and low mechanical strength that is difficult to hold via protrusions such as ribs.

Figure 7:
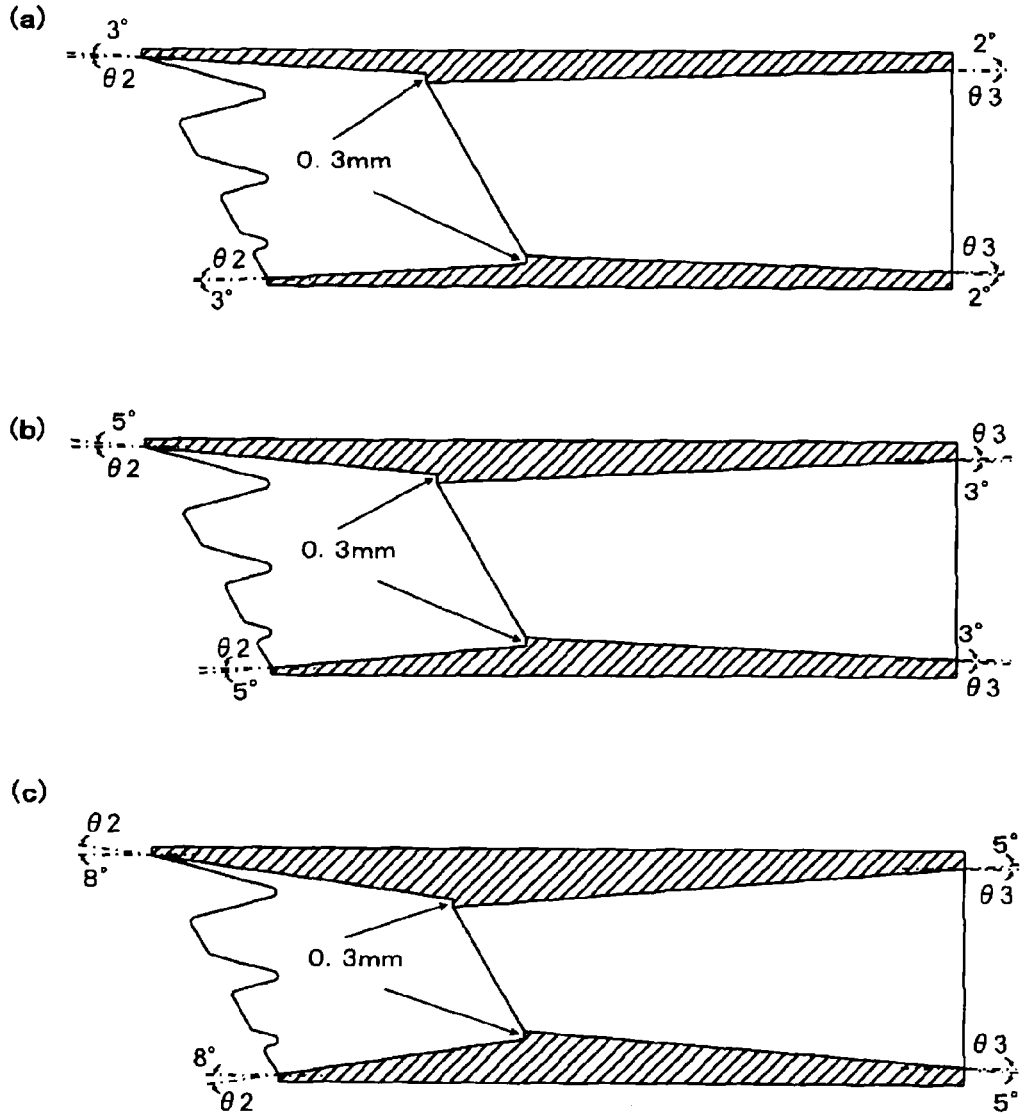
FIG. 7 An embodiment in the case where the height of a step portion in the stick-type cosmetic holder of the invention is constant, while the taper angles of tapered surfaces are varied.

FIG. 7(*a*) to (*c*) shows an embodiment in the case where the height of the step portion 12 is constant, while the taper angle of the upper tapered surface 13 and the taper angle of the lower tapered portion 14 are varied. Specifically, the height of the step portion 12 is 0.3 mm, a taper angle θ2 of the upper tapered surface 13 is 3°, 5° and 8°, and a taper angle θ3 of the lower tapered surface 14 is 2°, 3° and 5°. Here, the "taper angle" refers to the inclination angle in the relation with the outer peripheral wall when the outer peripheral wall of the stick-type cosmetic holder 1 is in parallel with the axial center A. As illustrated, when the step portion 12 is set to a constant height of 0.3 mm, adjusting the taper angles of the upper tapered surface 13 and the lower tapered surface 14 enables setting of a holding strength corresponding to the hardness of the cosmetic. In the case of a stick-type cosmetic with normal hardness, it is preferable to set the taper angle θ2 within a range of 3° to 8° from the upper opening 15 to the step portion 12, and to set the taper angle θ3 within a range of 2° to 5° from the lower opening 16 to the step portion 12, as shown in FIG. 7(*a*) to (*c*).

Figure 8:
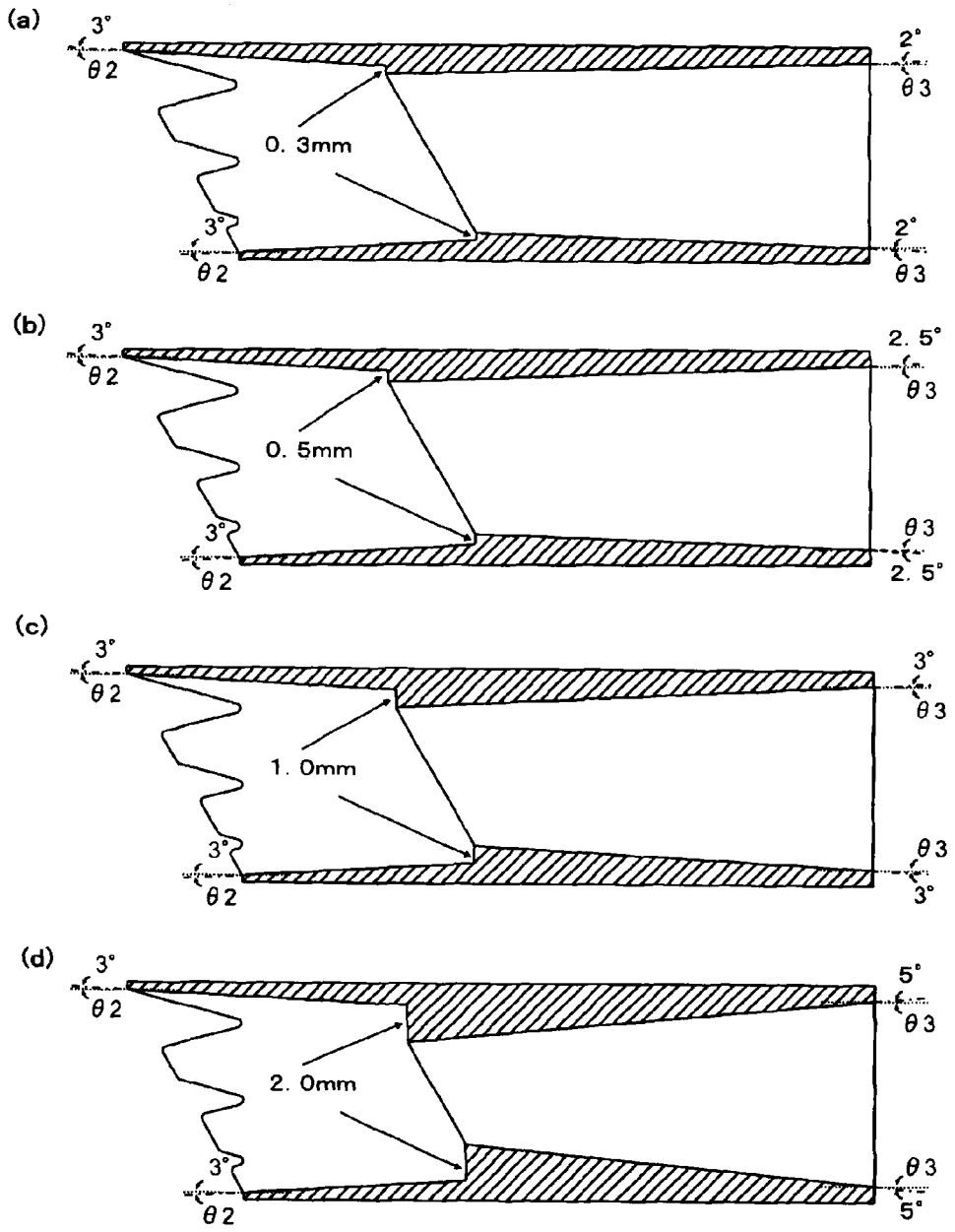
FIG. 8 An embodiment in the case where taper angle of an upper tapered surface in the stick-type cosmetic holder of the invention is constant, while the height of the step portion and the taper angle of a lower tapered surface are varied.

FIG. 8(*a*) to (*d*) show an embodiment in the case where the taper angle of the upper tapered surface 13 is constant, while the height of the step portion 12 and the taper angle of the lower tapered surface 14 are varied. Specifically, the height of the step portion 12 is 0.3, 0.5, 1.0 and 2.0 mm, the taper angle θ2 of the upper tapered surface 13 is 3°, and the taper angle θ3 of the lower tapered surface 14 is 2°, 2.5°, 3° and 5°. As illustrated, when the taper angle θ2 of the upper tapered surface 13 is set to a constant angle of 3°, adjusting the height of the step portion 12 and the taper angle θ3 of the lower tapered surface 14 enables setting of a holding strength corresponding to the hardness of the cosmetic. In the case of a stick-type cosmetic with normal hardness, it is preferable to form the height of the step portion 12 within a range of 0.3 to 2.0 mm, and to set the taper angle within a range of 2° to 5° from the lower opening 16 to the step portion 12, as shown in FIG. 8(*a*) to (*d*).

Also, the height of the step portion 12 may be decided based on the ratio to the inner diameter of the stick-type cosmetic holder 1. That is, when the stick-type cosmetic has normal hardness, if the inner diameter of the stick-type cosmetic holder 1 is 8 to 20 mmØ, the ratio of the height dimension of the step portion 12 to the inner diameter dimension of the stick-type cosmetic holder 1 can be set within a range of 0.01 to 0.2, preferably 0.02 to 0.1, and particularly preferably 0.025 to 0.05. Here, the "inner diameter of the stick-type cosmetic holder 1" is based on the inner diameter of the end on the side of the lower opening 16 of the stick-type cosmetic holder 1 as a reference.

The stick-type cosmetic with "normal hardness" mentioned here refers to a stick-type cosmetic formed of a solid cosmetic manifesting a degree of hardness such that a needle penetration load value S (g) by the following measuring method is within a range of 120 to 240 (g). In particular, a cosmetic with hardness such that the value is within a range of 150 to 210 (g) can enjoy the effects of the present invention better and can provide a stick-type cosmetic product with particularly high quality both in terms of the engagement holding property onto the holder and in terms of the touch. The composition of such a stick-type cosmetic is not limited as long as the needle penetration load value S (g) is within the above range. For example, in a base containing a solid oil that serves as a structure to keep the cosmetic in the rod shape, and a non-solid oil to adjust the touch at the time of application, the amount of application and the like as principal components, the content of the solid oil in the base may be 5 to 15% by mass, preferably 8 to 12% by mass, and coloring matters, pigments, beauty ingredients, preservatives, antioxidants and the like may be added to the base preferably by approximately 0.0001 to 20 parts by mass to 100 parts by mass of the base.

Measuring Method for Needle Penetration Load Value S

A melted cosmetic is poured into a metallic tray and cooled and solidified, thus forming a sample. After the sample is left in a stationary state for an hour at a measuring temperature of 35° C., a plunger having a circular distal end surface of 3 mm in diameter is pushed in to a depth of 2 mm perpendicularly from the sample surface under the condition of a speed of 6 cm per minute, using a needle penetration load measuring device (a rheometer manufactured by FUDO Kougyou, Inc. or the like), and stress (g) applied to the plunger during this time is measured. Maximum stress (g) at this time is used as the needle penetration load value S (g).

In the composition of the stick-type cosmetic, the solid oil is not limited as long as it is an oil-based ingredient that is solid at normal temperatures and forms the structure of the stick-type cosmetic. Preferable examples may include hydrocarbon waxes such as ethylene-propylene copolymer, polyethylene wax, ozocerite wax, ceresin wax, microcrystalline wax, Fischer-Tropsch wax, and paraffin wax, and ester-based waxes such as carnauba wax and candelilla wax. Of these, ethylene-propylene copolymer is particularly preferable in terms of shape holding property and uniformity of the coating film after application.

The non-solid oil may be liquid oils, paste oils, oil gelatinizers, oil-soluble resins and the like. Specifically, these may include: hydrocarbons such as liquid paraffin, heavy liquid isoparaffin, alpha-olefin oligomer, polyisobutylene, polybutene, squalane, and petrolatum; vegetable oils such as olive oil, castor oil, jojoba oil, and macadamia nut oil; esters such as cetyl 2-ethylhexanoate, isopropyl myristate, isopropyl palmitate, octyldodecyl myristate, and pentaerythrit rosinate; glycerides such as glyceryl tri(2-ethylhexanoate), polyglyceryl diisostearate, diglyceryl triisostearate, diglyceryl tetraisostearate, glyceryl tribehenate, and polyglyceryl decaisostearate; amino acid derivatives such as di(phytosteryl/2-octyldodecyl) N lauroyl-L-glutamate, di(cholesteryl/behenyl/octyldodecyl) N lauroyl-L-glutamate, and di(cholesteryl/octyldodecyl) N lauroyl-L-glutamate; higher alcohols such as stearyl alcohol, cetyl alcohol, lauryl alcohol, oleyl alcohol, isostearyl alcohol, and benenyl alcohol; silicones such as highly polymerized dimethylpolysiloxane, methylphenylpolysiloxane, polyether-denatured polysiloxane, alkoxy-denatured polysiloxane, and cross-linked organopolysiloxane; fluorine oils such as perfluorodecane, perfluorooctane, and perfluoropolyether; and polysaccharide fatty acid esters such as dextrin palmitate, dextrin stearate, dextrin behenate, palm oil fatty acid dextrin, dextrin laurate, and inulin stearate.

The coloring matters and pigments may include: white inorganic pigments such as titanium oxide, zinc oxide, cerium oxide, and barium sulfate; colored inorganic pigments such as iron oxide, carbon black, chromium oxide, chromium hydroxide, Prussian blue, and lapis lazuli; inorganic extender pigments such as talc, muscovite, phlogopite, lepidolite, biotite, synthetic mica, sericite, synthetic sericite, kaolin, silicon carbide, bentonite, smectite, aluminum oxide, magnesium oxide, zirconium oxide, diatomite, aluminum silicate, aluminum magnesium metasilicate, calcium silicate, barium silicate, magnesium silicate, aerosol silicic anhydride, calcium carbonate, magnesium carbonate, hydroxyapatite, and boron nitride; glitter pigments such as titanium dioxide-coated mica, titanium dioxide-coated bismuth oxychloride, iron oxide titanium mica, Prussian blue-treated titanium mica, carmine-treated titanium mica, bismuth oxychloride, argentine, polyethylene terephthalate-aluminum-epoxy laminated powder, polyethylene terephthalate-polyolefin laminated film powder, and polyethylene terephthalate-polymethylmethacrylate laminated film powder; organic polymer powder pigments such as polyamide resin, polyethylene resin, polyacrylic resin, polyester resin, fluorine resin, cellulose resin, polystyrene resin, styrene-acryl copolymer resin, polypropylene resin, silicone resin, and urethane resin; organic extender pigments such as N-acyllysine, starch, silk powder, and cellulose powder; organic pigments such as Pig. Red 57-1 (Red 201), Pig. Red 57 (Red 202), Pig. Red 49(Na) (Red 205), Vat Red 1 (Red 226), Pig. Red 4 (Red 228), Pig. Orange 5 (Orange 203), Pig. Orange 13 (Orange 204), Pig. Blue 15 (Blue 404), Pig. Yellow 1 (Yellow 401), Acid Red 51 (Red 3), Acid Red 92 (Red 104), Acid Red 52 (Red 106), Acid Orange 7 (Orange 205), Acid Yellow 23 (Yellow 4), Food Yellow 3 (Yellow 5), Food Green (Green 3), Food Blue 2

(Blue 1), or zirconium, barium or aluminum lakes of these; and metal powders such as aluminum powder, gold powder, and sliver powder. One type or a combination of two or more types of these coloring matters and pigments can be used, and composites of these may also be used. The coloring matters and pigments in the form of powder may be surface-treated with one type or two or more types of fluorine compounds, silicone compounds, metal soaps, lecithin, hydrogenated lecithin, collagen, hydrocarbon, higher fatty acids, higher alcohols, esters, mineral-based waxes, animal/plant-based waxes, and surfactants.

The beauty ingredients may include UV absorbers such as benzophenone, para aminobenzoic acid ester, methoxycinnamic acid ester, salicylic acid, 4-tert-butyl-4'-methoxy dibenzoylmethane, and oxybenzone, and also known ingredients such as antiphlogistics, plant extract oils, vitamins, proteins, peptides, mucopolysaccharides, and polyhydric alcohols. The preservatives and antioxidants may include paraoxybenzoic acid ester, phenoxyethanol, butylhydroxyanisole, dibutylhydroxytoluene, and alpha-tocopherol.

As a preferable example of the composition of the stick-type cosmetic with normal hardness, the cosmetic having the following composition can be specifically given. This can be prepared by a usual method.

(Composition)

1. Base containing the following (1) and (2): 100 parts by mass
   (1) Ethylene-propylene copolymer
   10 to 11 percent by mass
   (2) Polyglyceryl decaisostearate-10
   89 to 90 percent by mass
2. Coloring matters and pigments: 0.0001 to 10 parts by mass Moreover, in the stick-type cosmetic holder 1 of this embodiment, a total of six cut-out portions 152 are formed on the opening edge 151. As a plurality of cut-out portions 152 are formed in this manner, the contact length between the upper edge of the holder and the outer peripheral surface of the cosmetic increases, thus enabling effective dispersion of the stress generated in the contraction at the time of cooling and solidifying, or the stress in use. With respect to a cosmetic on which particularly high stress is applied when contracting or in use, defects such as breaking and cracking of the cosmetic can be prevented with high probability.

The material of the stick-type cosmetic holder 1 of the present invention is not particularly limited as long as it can hold a stick-type cosmetic and can endure the heat of the melted cosmetic. One type or a combination of two or more types of various metals and synthetic resin materials can be used. In view of the ease of molding the holder itself and the ease of releasing the stick-type cosmetic from the mold or the like, resin materials such as polyethylene resin, polypropylene resin, polystyrene resin, polyacetal resin, polyacrylonitrile-styrene resin, and polyacrylonitrile-butadiene-styrene resin can be suitably used.

It should be noted that the provision of ribs on the inner wall of the stick-type cosmetic holder of the present invention is not eliminated, if within a range that does not impair the effects of the invention.

The stick-type cosmetic holder of the present invention can be used in any container for stick-type cosmetic in which this holder can be installed, and can be utilized very advantageously in containers for stick-type cosmetics such as lipstick, lip cream, stick-type concealer, skin-whitening stick, and sunblock stick.

REFERENCE SIGNS LIST

1 . . . stick-type cosmetic holder
2 . . . sleeve
3 . . . rotating cylinder
4 . . . container outer cylinder
11 . . . peripheral wall
12 . . . step portion
13 . . . upper tapered surface
14 . . . lower tapered surface
15 . . . upper opening
16 . . . lower opening
17 . . . protruding portion
21 . . . guide groove for holder
31 . . . spiral groove
41 . . . container bottom filling hole
151 . . . opening edge
152 . . . cut-out portion
A . . . axial center
θ1 . . . inclination angle between axial center and step portion
θ2 . . . taper angle of upper tapered surface
θ3 . . . taper angle of lower tapered surface

The invention claimed is:

1. A stick-type cosmetic holder formed in a cylindrical shape opened at upper and lower ends, comprising:
   an inner peripheral surface including an inner diameter gradually decreased from an upper opening downward to provide an upper tapered surface, and the inner diameter is gradually decreased from a lower opening upward to provide a lower tapered surface; and
   a single annular step portion forming a step such that a lower tapered surface side is higher than an upper tapered surface side,
   the single annular step provided at a boundary between the upper tapered surface and the lower tapered surface,
   the step portion formed with an inclination angle in relation to an axial center as viewed from a lateral side, and
   taper angles of the upper and lower tapered surfaces are 1° to 10°.

2. The stick-type cosmetic holder according to claim 1, wherein a height of the step portion is 0.1 to 2.0 mm.

3. The stick-type cosmetic holder according to claim 1, wherein a height of the step portion is 0.3 mm, the taper angle of the upper tapered surface is 3° to 8°, and the taper angle of the lower tapered surface is 2° to 5°.

4. The stick-type cosmetic holder according to claim 1, wherein a height of the step portion is 0.3 to 2.0 mm, the taper angle of the upper tapered surface is 3°, and the taper angle of the lower tapered surface is 2° to 5°.

5. The stick-type cosmetic holder according to claim 1, wherein the inclination angle of the step portion in relation to the axial center of the stick-type cosmetic holder is 45° to 60°.

6. The stick-type cosmetic holder according to claim 2, wherein the inclination angle of the step portion in relation to the axial center of the stick-type cosmetic holder is 45° to 60°.

7. The stick-type cosmetic holder according to claim 3, wherein the inclination angle of the step portion in relation to the axial center of the stick-type cosmetic holder is 45° to 60°.

8. The stick-type cosmetic holder according to claim 4, wherein the inclination angle of the step portion in relation to the axial center of the stick-type cosmetic holder is 45° to 60°.

9. The stick-type cosmetic holder according to claim 1, wherein a plurality of cut-out portions are formed along an opening edge at a distal end.

10. The stick-type cosmetic holder according to claim 1, wherein the step portion faces the upper opening.

* * * * *